US011643293B2

(12) United States Patent
Klipfel et al.

(10) Patent No.: US 11,643,293 B2
(45) Date of Patent: May 9, 2023

(54) METHOD FOR UNWINDING A BOBBIN OF A COILED SHEET AND KIT TO UNWIND A SHEET OF MATERIAL WOUND IN A BOBBIN

(71) Applicant: PHILIP MORRIS PRODUCTS S.A., Neuchatel (CH)

(72) Inventors: Yorick Klipfel, St-Saphorin-sur-Morges (CH); Marc Perrinjaquet, Chez-le-Bart (CH)

(73) Assignee: Philip Morris Products S.A., Neuchatel (CH)

( * ) Notice: Subject to any disclaimer, the term of this patent is extended or adjusted under 35 U.S.C. 154(b) by 684 days.

(21) Appl. No.: 16/615,631

(22) PCT Filed: May 30, 2018

(86) PCT No.: PCT/EP2018/064285
§ 371 (c)(1),
(2) Date: Nov. 21, 2019

(87) PCT Pub. No.: WO2018/220071
PCT Pub. Date: Dec. 6, 2018

(65) Prior Publication Data

US 2020/0170292 A1 Jun. 4, 2020

(30) Foreign Application Priority Data

May 30, 2017 (EP) ..... 17173522

(51) Int. Cl.
*A24C 5/20* (2006.01)
*B65H 16/10* (2006.01)
(Continued)

(52) U.S. Cl.
CPC ..... *B65H 16/103* (2013.01); *A24C 5/20* (2013.01); *A24B 3/14* (2013.01); *A24B 15/12* (2013.01);
(Continued)

(58) Field of Classification Search
CPC ..... B65H 16/103; B65H 2511/142; B65H 2513/11; B65H 2801/54; A24C 5/20; A24B 3/14; A24B 15/12
See application file for complete search history.

(56) References Cited

U.S. PATENT DOCUMENTS 3,423,040 A 1/1969 Humphrey
3,738,587 A * 6/1973 Cristiani ..... B65H 19/1852 242/554.2
(Continued)

FOREIGN PATENT DOCUMENTS

CA 599791 6/1960
CN 102574650 7/2012
(Continued)

OTHER PUBLICATIONS

Office Action issued in Japan for Application No. 2019-565527 dated Apr. 4, 2022 (7 pages). English translation included.
(Continued)

*Primary Examiner* — Sang K Kim
(74) *Attorney, Agent, or Firm* — Mueting Raasch Group

(57) ABSTRACT

The present invention relates to a method for unwinding a bobbin (12) of a coiled sheet (13), the method comprising the steps of: providing a bobbin of a coiled sheet, the bobbin having a first rotation axis (17) and comprising a free portion (14) of the sheet unwound from the bobbin, the free portion (14) defining a contact line (16) as a line separating the free portion and the remaining of the coiled sheet (13); providing a roller (30) having a second rotation axis substantially
(Continued)

parallel to the first rotation axis (17); putting the roller (30) in contact with the bobbin (12) at the contact line (16); unwinding the sheet from the bobbin (12) pulling the sheet in an unwinding direction such that an angle between the free portion of the sheet and a radius of the bobbin at the contact line is comprised between about 110 degrees and about 150 degrees or between about 200 degrees and about 300 degrees; and while unwinding the sheet from the bobbin keeping the roller in contact with the outer surface of the bobbin. The present invention also relates to a kit to unwind a sheet of material wound in a bobbin.

12 Claims, 3 Drawing Sheets

(51) Int. Cl.
*A24B 3/14* (2006.01)
*A24B 15/12* (2006.01)

(52) U.S. Cl.
CPC ..... *B65H 2511/14* (2013.01); *B65H 2513/11* (2013.01); *B65H 2801/54* (2013.01)

(56) References Cited

U.S. PATENT DOCUMENTS

| | | | | |
|---|---|---|---|---|
| 4,579,292 | A | 4/1986 | Weber | |
| 5,816,149 | A | 10/1998 | Kagawa | |
| 8,733,686 | B2 * | 5/2014 | Binner, Sr. ..... | B65H 23/185 242/420.5 |
| 2011/0062274 | A1 | 3/2011 | Carla | |
| 2012/0097787 | A1 | 4/2012 | Binner | |

FOREIGN PATENT DOCUMENTS

| | | |
|---|---|---|
| EP | 0882412 | 12/1998 |
| FR | 2429565 | 1/1980 |
| GB | 946961 | 1/1964 |
| GB | 956 961 | 4/1964 |
| JP | H03-130254 | 12/1991 |
| SU | 1299927 | 3/1987 |
| WO | WO 2017/063958 | 4/2017 |

OTHER PUBLICATIONS

PCT Search Report and Written Opinion for PCT/EP2018/064285 dated Jul. 2, 2018 (14 pages).
International Preliminary Report on Patentability for PCT/EP2018/064285 dated May 6, 2019 (15 pages).
Office Action issued in China for Application No. 201880030937.X dated Sep. 1, 2020 (17 pages). English translation included.
Decision on Grant issued in Russia for Application No. 2019139234 (17 pages) dated Apr. 22, 2022. English translation included.
Gost, "Interstate Standard, Unified System for Design Documentation, Product Types", Mar. 1, 2017, 11 pages.

* cited by examiner

METHOD FOR UNWINDING A BOBBIN OF A COILED SHEET AND KIT TO UNWIND A SHEET OF MATERIAL WOUND IN A BOBBIN

This application is a U.S. National Stage Application of International Application No. PCT/EP2018/064285 filed May 30, 2018, which was published in English on Dec. 6, 2018 as International Publication No. WO 2018/220071 A1. International Application No. PCT/EP2018/064285 claims priority to European Application No. 17173522.8 filed May 30, 2017.

The present invention is related to a method for unwinding a bobbin of a coiled sheet and to a kit to unwind a sheet of material wound in a bobbin. In a specific embodiment, the method and the kit are directed to the unwinding of a sheet of homogenized tobacco material wound in a bobbin. Unwinding bobbins of material can be a difficult task, when the material which is coiled to form a bobbin is at the same time both sticky, so a rather high force need to be applied in order to unwind it, and fragile, so that it can be easily torn apart. Such a material is for example homogenized tobacco sheet, which can be obtained for example casting a sheet of homogenized tobacco material. The homogenized tobacco sheet, when coiled in bobbins, is difficult to unwind due to its consistency, sensitivity to heat and low tensile strength, all preventing for instance to simply increase the force applied to the sheet to unwind the bobbin.

In current manufacturing process of homogenized tobacco material, the bobbins are placed in rotating shafts by the operator or by an automatic system. During the start-up of the equipment and once the bobbins are in place in the unwinding system, a certain tension is applied while pulling the homogenized tobacco material sheet. While the equipment speed increases up to the cruise speed, the tension applied to the sheet has to be regulated within a certain range in order to avoid the rupture and total breakage of the homogenized tobacco material sheet. In this way, unwinding speed has to be lowered in order to prevent as much as possible to tear the homogenized tobacco sheet, which in turn automatically decreases the production speed and hourly production.

In case the homogenized tobacco material sheet breaks, during the unwinding process to feed for example a crimping equipment, the crimping equipment stops after depleting the quantity of the homogenized tobacco material sheet existing in its buffering system. The buffered material is usually short, as it only generally compensates and recovers from the estimated time to change bobbins of homogenized tobacco material sheet. Such equipment stoppages may happen often due to stickiness of the bobbins resulting from chemical structural alteration of the homogenized tobacco material sheet over time which causes a high level of adhesion between layers of the homogenized tobacco material sheet in the bobbins. Due to the stickiness, it may be difficult to unwind the bobbins without breaking the homogenized tobacco material sheet, as the tension and pulling force needed to unwind the bobbins supersedes the force that causes rupture and complete breakage of the homogenized tobacco material sheet.

The problem of stickiness in homogenized tobacco material sheet bobbins may occur after storage of the homogenized tobacco material in controlled temperature cold room when exceeding one day or two days of storage time.

In addition to the low tensile strength of the material, some bobbins of homogenized tobacco sheet have quite variable shapes from one to another, so this shape inhomogeneity may be taken into account in an apparatus and a method to unwind bobbins of homogenized tobacco sheet. There is therefore a need of a method and a kit to unwind bobbins of coiled sheet, in particular of sheets of material having low textile strength and/or being sticky, to optimize the unwinding of the homogenized tobacco material sheet. The method and the kit preferably minimize the material breakages, so that the crimping equipment may work continuously, reducing production stoppages, related costs and all related negative impact in manufacturing. These method and kit are preferably capable to increase the unwinding speed so that the rest of the production line can increase the overall production rate. Further, the method and the kit preferably take into account adjustments in position due to the different bobbin shapes as well as due to the unwinding of the bobbins.

In a first aspect, the invention relates to a method for unwinding a bobbin of a coiled sheet, the method comprising the steps of: providing a bobbin of a coiled sheet, the bobbin having a first rotation axis and comprising a free portion of the sheet unwound from the bobbin, the free portion defining a contact line as a line separating the free portion and the remaining of the coiled sheet; providing a roller having a second rotation axis substantially parallel to the first rotation axis; putting the roller in contact with the bobbin at the contact line; and unwinding the sheet from the bobbin keeping the roller in contact with the outer surface of the bobbin.

In a further aspect, the invention relates to a method for unwinding a bobbin of a coiled sheet, the method comprising the steps of: providing a bobbin of a coiled sheet, the bobbin having a first rotation axis and comprising a free portion of the sheet unwound from the bobbin, the free portion defining a contact line as a line separating the free portion and the remaining of the coiled sheet; providing a roller having a second rotation axis substantially parallel to the first rotation axis; putting the roller in contact with the bobbin at the contact line; unwinding the sheet from the bobbin pulling the sheet in an unwinding direction such that an angle between the free portion of the sheet and a radius of the bobbin at the contact line is comprised between about 110 degrees and about 150 degrees or between about 200 degrees and about 300 degrees; and while unwinding the sheet from the bobbin, keeping the roller in contact with the outer surface of the bobbin.

In order to properly unwind the bobbin, keeping in mind its possible stickiness and fragility and thus minimizing breakage but at the same time keeping a relatively high unwinding speed, according to the invention it is proposed to arrange an unwinding roller in contact with the outer surface of a bobbin to be unwound, at the contact line that separates the free portion of the sheet unwound from the bobbin from the rest of the bobbin. The unwinding roller is arranged close to a main bobbin and in contact with the unwound sheet during unrolling, to force the unwound sheet to detach from the main bobbin at a point located downstream the natural tangent point. When unwinding the bobbin by pulling the free portion of the sheet unwound from the bobbin, the provision of the roller may imposes a low angle between the free portion of the sheet and the tangent to the radius of the bobbin at the contact line. It has been found that in this way the mechanical stress imposed on the sheet during unwinding may be stabilized and controlled within an acceptable range, thus avoiding or minimizing the rupture/breakage of the sheet while keeping a relatively high unwinding speed. This is particular advantageous in case of materials, like homogenized tobacco material, that tend to be at the same time both sticky, so a rather high force need to be applied in order to unwind it, and fragile, so that it can be easily torn apart. When unwinding bobbins made of coiled sheet of homogenized tobacco material with the method according to the invention, the reduction or elimination of rupture/breakage of the sheets may possibly increase the unwinding speed and also the overall production rate.

Further, the method of the invention is relatively simple to be applied and does not require expensive or complex machinery.

As used herein, the term "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and 300 millimeters.

In a preferred embodiment, the sheet is a sheet of homogenized tobacco material.

As used herein, the term "homogenised tobacco material" denotes material formed by agglomerating particulate tobacco, which contains the alkaloid nicotine.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The sheet of homogenized tobacco material can be referred to as a reconstituted sheet material and formed using particulate tobacco (for example, reconstituted tobacco) or a tobacco particulate blend, a humectant and an aqueous solvent to form the tobacco composition. This tobacco composition is then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet of homogenized tobacco material is then rolled in bobbins which needs to be unwound in order to be further processed, to be part for example of an aerosol-forming article, that is to be included in the aerosol-forming substrate of the aerosol-forming article. In a "heat-not-burn" aerosol-generating article, an aerosol-forming substrate is heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol-generating article. This means that the aerosol composition that is generated by such a "heat-not-burn" aerosol-generating article is substantially only based on the homogenized tobacco material.

As used herein, the term "aerosol forming material" denotes a material that is capable of releasing volatile compounds upon heating to generate an aerosol. A sheet of homogenized tobacco comprising an aerosol former may be classed as an aerosol forming material. An aerosol forming substrate may comprise or consist of an aerosol forming material.

The homogenized tobacco sheet generally includes, in addition to the tobacco, a binder and an aerosol-former, such as guar and glycerine. This composition leads to a sheet which is "sticky", that is, it glues to adjacent objects, and at the same time it is rather fragile having a relatively low tensile strength.

The homogenised tobacco material may have an aerosol-former content of greater than about 5 percent on a dry weight basis. The homogenised tobacco material may alternatively have an aerosol former content of between about 5 percent and about 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and nonaqueous solvents and combinations thereof.

Examples of suitable aerosol formers are glycerine and propylene glycol. The starting point of the invention is a bobbin of a coiled sheet. The sheet could be formed in any material.

The bobbin defines an outer surface, which comprises the end of the sheet which is wound in the bobbin, called free end. The end of the sheet is loose, that is, it is not blocked to the bobbin by the additional layers of sheet wound on top of it. Therefore, the end of the bobbin can be pulled and the bobbin may unwind. The dividing line between the portion of the last coil of the wound sheet which is still in contact with a layer underneath and the portion of sheet which does not touch any further layer of sheet is called the contact line of the bobbin.

Once a sheet of a material is produced, such as a sheet of homogenized tobacco material, it often needs to be stored at least for a certain time before it is further processed. In order to store it properly, without or with minimal risks of breakage or without occupying too much space, it is commonly wound into bobbins. However, winding sheet of certain materials in a bobbin as such may create several problems in the subsequent unwinding, due to the "sticky" properties of the sheets. Due to the fact that some sheets may be sticky, the layers formed in the bobbin by the sheet wound in itself are prone to glue one onto the others, preventing unwinding. The present invention is especially adapted to unwind bobbins made of homogenized tobacco material as defined above, however it can be applied as well in any process wherein a sheet having such characteristics need to be unwound from a bobbin.

The bobbin shape can be any. It can have a substantially cylindrical shape, however an oval or anyhow deformed shape, such as a bobbin with bulges deforming a underlying cylindrical shape, do not hinder the application of the teaching of the invention.

In order to unwind the bobbin, the free end of the sheet is pulled. The pulling may be performed by any means. Pulling the sheet means that a given force is applied to the sheet. The free end of the sheet defines the "contact line" with the remaining of the sheet wound in the bobbin.

A roller is put into contact with the external surface of the bobbin. Due to the presence of the roller and the pulling force, the contact line of the sheet shifts to the position of the roller. Therefore, the sheet detaches from the bobbin at the roller's location.

Therefore, the addition of such unwinding roller that "sits" on the bobbin provides a constant "peeling" line. The presence of this constant line may enable to keep the combination of forces acting on the sheet stable and the overall process consistent, while reducing the mechanical effort caused in the sheet in the line of "peeling". This also may enable to control the angles formed by the free end of the bobbin and the rest of the bobbin as well as the point of feeding inlet of the machine while being unwind.

The method according to the invention creates a setup that enables to process bobbins with the advantages described above, as well as it brings operational performance improvement as sticky bobbins can be recovered, thus possibly leading to a yield increase.

Preferably, the roller moves its angular position with respect of the bobbin while unwinding. The roller remains in contact to the bobbin while the bobbin is depleted. The angle formed between the radius of the bobbin touching the contact line and the free end of the sheet wound in the bobbin is preferably comprised between about 90 degrees (tangent situation) and about 300 degrees, where the sheet is wound around the roller and "returns" toward the bobbin.

This invention proposes to unwind the bobbins from the perimeter of the bobbin via a roller. It is generally accepted that the peeling angle is a good indication of the bobbins stickiness. The distance from the perimeter of the bobbin and the transfer roller increases with decreasing bobbin diameter, generating increasing fluctuations of the sheet. This oscillation generates a whipping effect that often overcomes the brittle sheet properties.

Preferably, the method of the invention includes pulling the free portion of the sheet in an unwinding direction such that an angle between the free portion of the sheet and the radius of the bobbin at the contact line is comprised between about 90 degrees and about 300 degrees. More preferably, the angle is comprised between about 110 degrees and about 150 degrees and approximately of about 130 degrees. In this way, the component of the mechanical stress perpendicular to the contact line while unwinding the bobbin is reduced, thus reducing the effect of the stickiness of the sheet on the unwinding. Further, this makes the unwinding process reproducible and "stable" for the bobbins. For all bobbins of a given size and material, the same unwinding characteristics are to be expected because a control on the stress applied to the sheet is obtained.

The free portion of the sheet may also make a "U-turn" around the roller. That is, the free portion may contact the majority of the perimeter of the roller and then continues to be pulled in a straight line. The angle formed in this case between the radius connecting the contact line and the free portion of the sheet where it is again straight is preferably comprised between about 200 degrees and about 300 degrees (the angle considered is the one between the radius and the end portion facing the bobbin). More preferably, it is comprised between about 250 degrees and about 290 degrees and approximately about 270 degrees.

Angles above 180 degrees indicate situation where the sheet perform a "U turn" around the compressing element.

In case a "U turn" is performed, an expanded contact between a perimeter of the compressing element and the free portion of the sheet is obtained during unwinding of the bobbin compared to the case in which no U-turn is performed. The contact between the sheet and the compressing element takes place for a relatively "long" portion of the sheet. The sheet preferably contacts the compressing element for at least about 20 percent, preferably at least about 40 percent, preferably at least about 60 percent of an outside perimeter of the compressing element. The sheet substantially "wraps around" the compressing element. This allows improving the stabilization and the control of the mechanical stress imposed on the sheet during unwinding within an acceptable range, thus further avoiding or minimizing the rupture/breakage of the sheet.

With radius of the bobbin at the contact line, the radius of the bobbin connecting the center of the bobbin with the contact line is meant.

With angle between the radius of the bobbin at the contact line and the free portion of the sheet, the angle formed between the defined radius and a direction defined by the free portion of the sheet connected to the rest of the bobbin, considering the sheet having a "irrelevant" thickness.

Preferably therefore the free portion of the sheet and the radius at the contact line form an angle which is either in a first range or in a second range which are optimal for the unwooding in particular for bobbin which are sticky and more preferably for bobbin which are sticky in an uneven manner.

Preferably, the method of the invention includes rotating the roller in a direction opposite to a rotation direction of the bobbin during unwinding. The unwinding of the sheet and the consequent friction on the roller triggers a rotation of the roller in the opposite direction than the rotation of the bob bin.

Preferably, the method of the invention includes placing the free end portion of the sheet in contact with the roller for a length equal to at least about 40 percent of the perimeter of the roller. In this way, a stable contact line is formed and the sheet of material wraps for a predetermined sufficient length around the roller before moving away from it, so that the sheet of material is not damaged.

Preferably, the method of the invention comprises moving the position of the roller ent while unwinding the sheet, so that an angle between the free portion of the sheet and the radius of the bobbin at the contact line is comprised between about 90 degrees and about 300 degrees during unwinding. More preferably, the angle is kept between about 110 degrees and about 150 degrees and approximately at about 130 degrees during unwinding. More preferably, the angle is kept between about 200 degrees and about 300 degrees during unwinding. The advantage above stated is preferably kept during the whole unwinding of the bobbin.

Preferably, the method of the invention includes arranging a scraper between the free portion of the sheet and the remaining of the sheet coiled in the bobbin in such a way that the scraper is in contact with the sheet coiled in the bobbin. Advantageously, the scraper assists in the detachment of the free end of the sheet from the rest of the bobbin.

Preferably, the method of the invention includes: determining a roundness of the bobbin; and selecting an unwinding velocity of the bobbin based on the determined roundness.

Preferably, a sensor is used to determine the roundness of the bobbin, such as a contact sensor. If the bobbin is cylindrical, then preferably adjustment of the speed are not necessary. If the bobbin is deformed, then the speed is preferably adjusted, such as throttled.

Preferably, the method of the invention includes sensing a diameter of the bobbin. This allows to correctly position the roller at any point in time during unwinding as well as detecting when the bobbin needs to be replaced.

Preferably, the sheet is a sheet of a material containing alkaloids. More preferably, the sheet is a sheet of homogenised tobacco material.

An "alkaloids containing material" is a material which contains one or more alkaloids. Among alkaloids, nicotine is a preferred one, which can be found in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

According to a further aspect, the invention relates to a kit to unwind a sheet of material wound in a bobbin, the kit comprising: a bobbin of a coiled sheet defining an outer surface and a free portion of the sheet unwound from the bobbin, the free portion defining a contact line as a line separating the free portion and the remaining of the coiled sheet; an apparatus including: a bobbin holder holding the bobbin rotatable around a first axis; a roller having a second rotation axis substantially parallel to the first rotation axis, the roller being in contact with the outer surface of the bobbin at the contact line.

According to a further aspect, the invention relates to A kit to unwind a sheet of material wound in a bobbin, the kit comprising: a bobbin of a coiled sheet defining an outer surface and a free portion of the sheet unwound from the bobbin, the free portion defining a contact line as a line separating the free portion and the remaining of the coiled sheet; an apparatus including: a bobbin holder holding the bobbin rotatable around a first axis; a roller having a second rotation axis substantially parallel to the first rotation axis, the roller being in contact with the outer surface of the bobbin at the contact line; a pulling device adapted to pull the free portion of the sheet of the bobbin along an unwinding direction; wherein the roller and the pulling device are respectively positioned so that an angle between the free portion of the sheet along the unwinding direction and the radius of the bobbin at the contact line is comprised between about 110 degrees and about 150 degrees or between about 200 degrees and about 300 degrees.

The advantages of this kit have been already outlined with reference to the above method according to the invention and are not repeated herewith. Preferably, the roller is arranged in an angularly movable position with respect of the holder.

Preferably, the apparatus includes a pulling device so arranged that an angle between the free portion of the sheet and the radius of the bobbin at the contact line is comprised between about 90 degrees and about 300 degrees. More preferably, the angle is comprised between about 110 degrees and about 150 degrees and approximately of about 130 degrees. Preferably, the angle is comprised between about 200 degrees and about 300 degrees (the angle considered is the one between the radius and the end portion facing the bobbin). More preferably, it is comprised between about 250 degrees and about 290 degrees, and approximately about 270 degrees.

Preferably, the apparatus includes a scraper arranged between the free portion of the sheet and the remaining of the sheet coiled in the bobbin in such a way that the scraper is in contact with the sheet coiled in the bobbin. An easier detachment of the free end of the sheet may be achieved.

Preferably, the apparatus includes a speed regulator to vary the rotation speed around the first axis of the bobbin holder. The unwinding speed can be therefore controlled.

Preferably, the apparatus includes a diameter sensor to determine the diameter of the bobbin.

Further advantages of the invention will become apparent from the detailed description thereof with no-limiting reference to the appended drawings.

Figure 1:
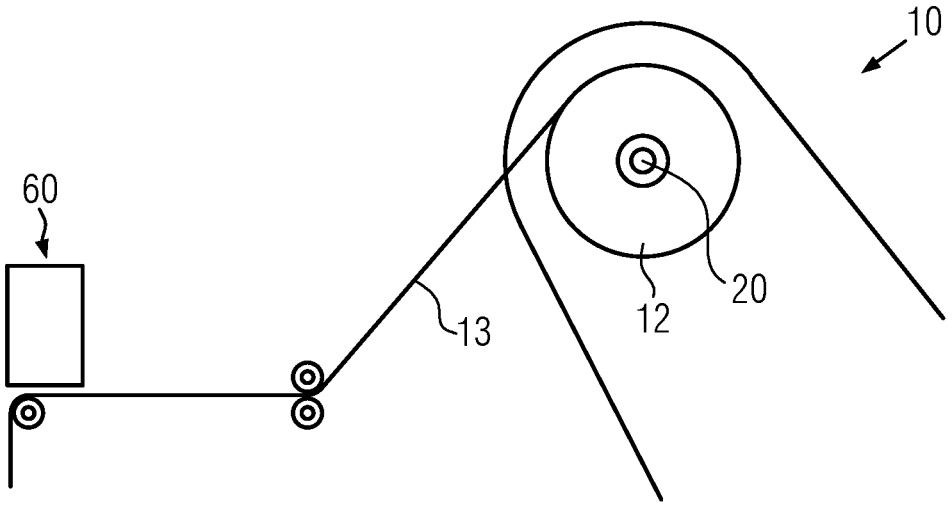
FIG. 1 is a schematic side view of an apparatus to unwind a sheet of material wound in a bobbin according to a comparative embodiment.
Figure 2:
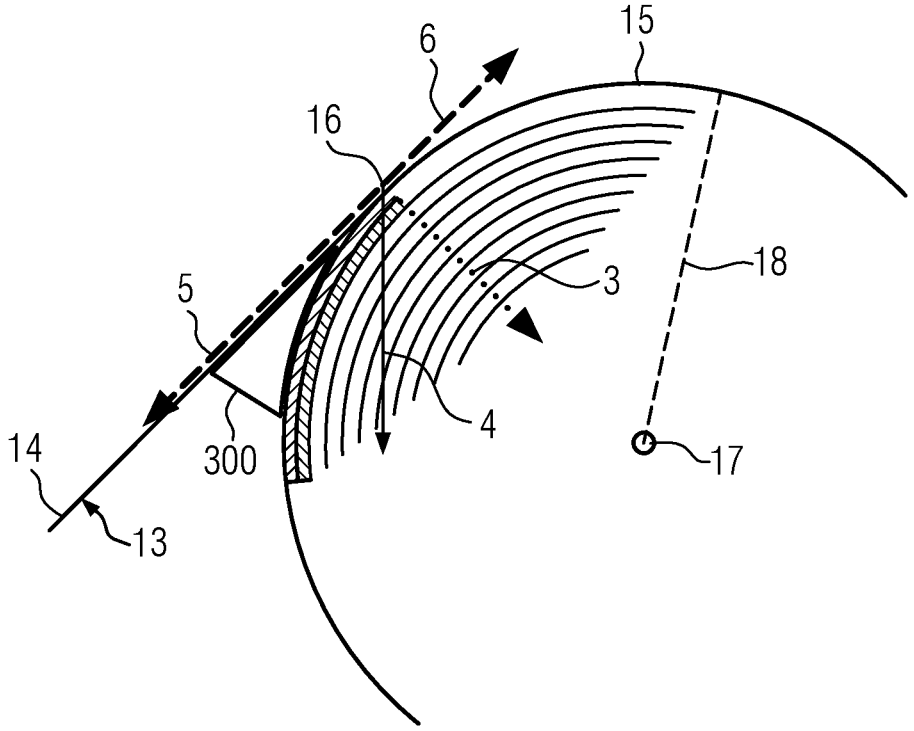
FIG. 2 is a schematic side view of the bobbin of FIG. 1, wherein forces involved during unwinding the bobbin are indicated.

With initial reference to FIGS. 1 and 2, an apparatus to unwind a sheet of material 13 wound in a bobbin according to a comparative example is represented and indicated with reference number 10.

The apparatus 10 is adapted to unwind the bobbin 12.

For instance, the bobbin 12 can be a homogenized tobacco material bobbin. However, the invention can be applied to all industries where manufacturing processes include the unwinding of bobbins having sticky and fragile sheets, for instance, paper industry or industry using polymer sheets coiled in bobbins.

The bobbin 12 shown in FIGS. 1 and 2 has a round, for example cylindrical, shape. However, the invention works fine with bobbins even when the bobbins do not have round shape.

The apparatus 10 comprises a bobbin holder 20 where the bobbin 12 is placed.

The bobbin holder 20 holds the bobbin 12. Preferably, a center of the bobbin holder 20 coincides with a center 17 of the bobbin 12. Preferably, the bobbin 12 is inserted in the bobbin holder 20. The bobbin holder 20 is rotatable around an axis passing through its center.

The bobbin 12 is formed by the coiled sheet 13. The apparatus 10 is adapted to unwind the coiled sheet 13 of the bobbin 12, as shown in FIGS. 1 and 2.

Bobbin 12 is formed by winding the sheet 13 of material, which defines a free portion 14 of the sheet 13 unwound from the bobbin 12 and defines an outer surface 15.

The separation line between the free portion 14 of the sheet 13 and the remaining of the bobbin 12 is called contact line 16. Further, bobbin 12 defines a radius 18 (represented as a dotted line in FIG. 2).

The comparative embodiment of unwinding apparatus 10 includes also the related set-up for unwinding the tobacco cast leaf bobbin 12 to feed a crimping machine 60, and combination of forces involved during the process of unwinding the bobbin 12.

The cast leaf sheet 13 is pulled towards the feeding inlet of the crimping machine 60, and the point, transversal line (i.e. contact line 16), of detachment of the cast leaf sheet 13 from the bobbin 12 is moving depending of the adhesion between the last two layers of cast leaf sheet 13 in the bobbin 12. This point of detachment tends to be as described in FIG. 2 in terms of the combination of forces involved.

The dashed forces depicted as arrows in FIG. 2 and labelled 5 and 6 are the pulling forces (with reaction), the dotted arrow 3 is the compression force and the continuous line arrow 4 is the resulting force of all forces named above.

Figure 3:
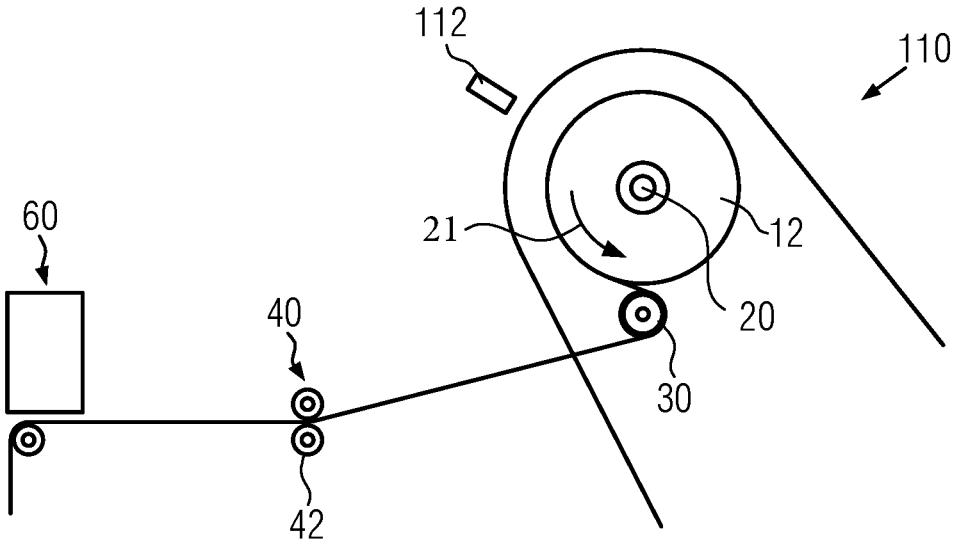
FIG. 3 is a schematic side view of a first embodiment of an apparatus to unwind a sheet of material wound in a bobbin according to the invention.
Figure 6:
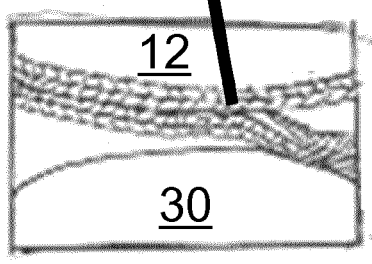
FIG. 6 is a schematic side view of a detail of the apparatus of FIG. 5.
Figure 5:
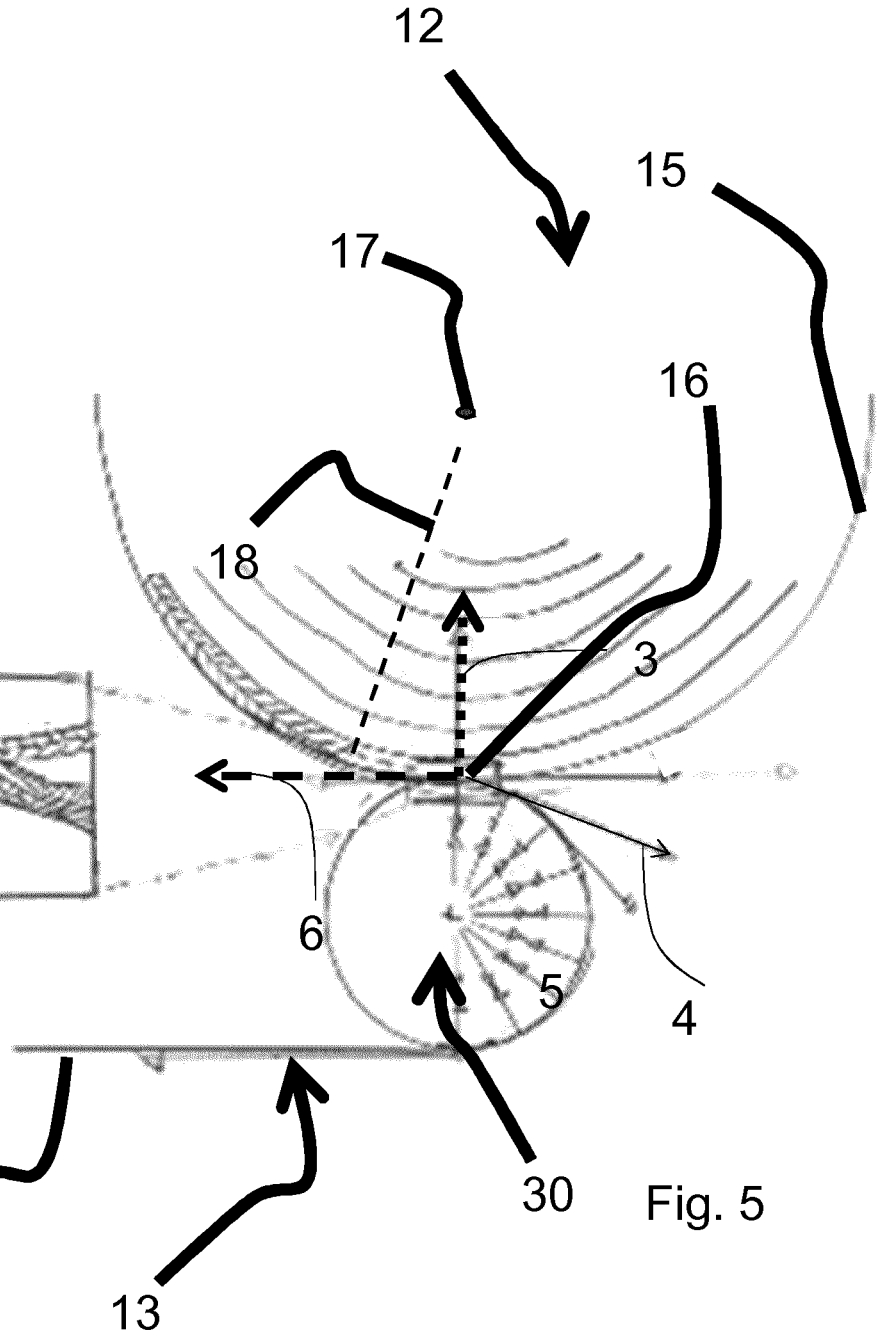
FIG. 5 is a schematic side view of the apparatus of FIG. 3, wherein forces involved during unwinding the bobbin are indicated.

With reference to FIGS. 3, 5 and 6, a first embodiment of apparatus 110 to unwind a sheet 13 of material wound in a bobbin 12 according to the invention is represented. Sheet and bobbin are as described with reference to the comparative example and thus the same reference numerals are used.

Components of the apparatus 110 which are analogous or functionally equivalent to those of the apparatus 10 are indicated with the same reference numbers and are not repeated herewith.

The bobbin 12 of a coiled sheet 13 defines the outer surface 15 and a free portion 14 of the sheet 13 unwound from the bobbin 12. The free portion 14 defines a contact line 16 as a line separating the free portion 14 and the remaining of the coiled sheet 13.

The apparatus 110 includes the bobbin holder 20, holding the bobbin 12 rotatable around a first rotation axis, and a roller 30 having a second rotation axis substantially parallel to the first rotation axis.

The roller 30 is in contact with the outer surface 15 of the bobbin 12 and defines the contact line 16, which separate the free portion 14 from the rest of the bobbin 12, when the free portion 14 is pulled as detailed below.

The roller 30 rotates in a direction opposite to a rotation direction 21 of the bobbin 12 during unwinding. In the side view of FIG. 3, the rotation direction 21 is the counterclockwise direction.

The second rotation axis of the roller 30 is located substantially under the bobbin 12, near to a vertical plane including the first rotation axis of the bobbin holder 20.

The roller 30 is arranged in a fixed position with respect of the holder 20. Alternatively, the apparatus 110 can comprise a position adjustment system adapted to change the position of the roller 20 with respect to the bobbin holder 20 depending on a dimension of the bobbin 12 present in the holder 20. In this case, the apparatus 110 comprises a control unit connected to the position adjustment system and adapted to command the position adjustment system to move the roller 30 towards the bobbin 12 as the dimension of the bobbin 12 reduces due to unwinding.

The apparatus 110 can be advantageously used in the unwinding process currently existing just before tobacco cast leaf crimping, in the process step of unwinding/feeding of the related crimping machine. The apparatus 110 (which is substantially a rolling apparatus) is integrated in the existing system, and does not involve relevant changes in the current overall equipment set-up.

The tension caused by the pulling force feeding the crimping equipment while unwinding the cast leaf in the bobbin 12, is first of all felt and converted in several portions by the roller 30 that is always in contact with the last/external layer/sheet 13 of the cast leaf in the bobbin 12, independently of the rotating speed and external diameter of the bobbin 12 (see FIG. 5).

According to the invention, a method for unwinding the bobbin 12 of the coiled sheet 12 comprises the steps of putting the roller 30 in contact with the bobbin 12 at the contact line 16 and unwinding the sheet 13 from the bobbin 12 keeping the roller 30 in contact with the outer surface 15 of the bobbin 12.

According to the invention, the apparatus 110 unwinds the cast leaf bobbin 12 from the outer perimeter thereof with a contact "peeling" by the roller 30. By the apparatus 110 with the roller 30 it is possible to control where the point/line of detachment occurs (i.e. the contact line 16), always in the same place if required.

Adding such unwinding roller 30 that "sits" on the bobbin 12, providing a constant "peeling" point/line placement, which then enables to keep the combination of forces stable and the overall process consistent, while reducing the mechanical effort caused in the cast leaf sheet 13 in the point/line of "peeling" (i.e. the contact line 16). This also enables to control the angles related to the center 17 of the bobbin 12 as well as the point of feeding inlet of the machine while being unwind.

The apparatus 110 includes a pulling device 40 of the free portion 14 of the sheet 13 in an unwinding direction.

The pulling device 40 comprises a pair of rollers 42 and pulls the free portion 14 of the bobbin 12 along an unwinding direction. The distance between the pulling device 40 and the bobbin 12 depends on the type of bobbin 12, the sheet material and the speed of unwinding.

During functioning, the free portion 14 is pulled along the unwinding direction by the pulling device 40. An angle is formed between the radius of the bobbin 12 and the free portion 14 of the sheet 13. This angle depends on the position of the pulling device 40, of the roller 30 and the bobbin 12. This angle varies during unwinding because the size (radius) of the bobbin 12 is reduced.

The pulling device 40 is arranged so that an angle between the free portion 14 of the sheet 13 and the radius of the bobbin 12 at the contact line 16 is comprised between either about 110 degrees and about 150 degrees (embodiment of FIG. 4 described below) or between about 200 degrees and 300 degrees (embodiment of FIG. 3).

The free end portion 14 of the sheet 13 is placed in contact with the roller 30 for a length equal to at least about 40 percent of the perimeter of the roller 30.

The apparatus 110 includes a diameter sensor 112 to determine the diameter of the bobbin 12.

The apparatus 110 can include a speed regulator (not illustrated) to vary the rotation speed around the first axis of the bobbin holder 20.

The unwinding method carried out by the apparatus 110 can include determining a roundness of the bobbin 12 and selecting an unwinding velocity of the bobbin 12 based on the determined roundness.

In an embodiment, the apparatus 110 include a scraper 300 arranged between the free portion 14 of the sheet 13 and the remaining of the sheet 13 coiled in the bobbin 12 in such a way that the scraper is in contact with the sheet 13 coiled in the bobbin 12.

Figure 4:
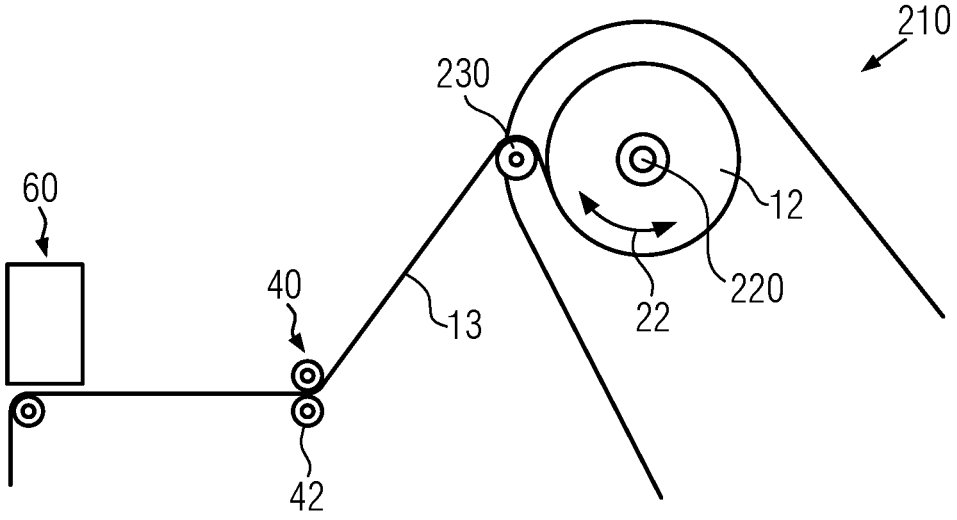
FIG. 4 is a schematic side view of a second embodiment of an apparatus for unwinding a bobbin according to the invention.

With reference to FIG. 4, a second embodiment of the apparatus 210 to unwind the sheet 13 of material wound in the bobbin 12 according to the invention is represented.

Components of the apparatus 210 which are analogous or functionally equivalent to those of the apparatus 110 are indicated with the same reference numbers and are not repeated herewith.

The apparatus 110 includes the bobbin holder 220, holding the bobbin 12 rotatable around a first rotation axis, and a roller 230 having a second rotation axis substantially parallel to the first rotation axis.

The roller 230 is in contact with the outer surface 15 of the bobbin 12 at the contact line 16.

The roller 230 rotates in a direction opposite to a rotation direction 22 of the bobbin 12 during unwinding. In the side view of FIG. 4, the rotation direction 22 is the clockwise direction.

The second rotation axis of the roller 230 is located substantially beside the bobbin 12, near to a horizontal plane including the first rotation axis of the bobbin holder 220.

The dashed force depicted as arrows in FIG. 5 and labelled 6 is the pulling force (with reaction), the dotted arrow 3 is the compression force and the continuous line arrow 4 is the resulting force of all forces named above. An enlargement of FIG. 5 is given in FIG. 6 where the contact line is shown, where the sheet detaches from the bobbin. The unwinding apparatus 110 is arranged to uncoil/unroll an elongated sheet 13 coiled or rolled to form a bobbin 12.

By using the apparatus 110 of the invention, the occurrences of breakings of the sheet 13 decrease and the yield of the sheet material advantageously increases.

Moreover, the apparatus 110 of the invention limits the heat transferred to the sheet 13. Therefore, in the case of tobacco cast leaves bobbins 12, the tobacco cast leaves are not damaged.

Furthermore, the apparatus 110 of the invention allows increasing the unwinding speed of the bobbins 12.

The invention claimed is:

1. A method for unwinding a bobbin of a coiled sheet including a homogenized tobacco sheet, the method comprising the steps of:

providing a bobbin of a coiled sheet including a sheet of a material comprising a homogenized tobacco sheet, the bobbin having a first rotation axis and comprising a free portion of the sheet unwound from the bobbin, the free portion defining a contact line as a line separating the free portion and the remaining of the coiled sheet;

providing a roller having a second rotation axis substantially parallel to the first rotation axis;

putting the roller in contact with the bobbin at the contact line;

unwinding the sheet from the bobbin pulling the sheet in an unwinding direction such that an angle between the free portion of the sheet and a radius of the bobbin at the contact line is comprised between about 110 degrees and about 150 degrees or between about 200 degrees and about 300 degrees;

while unwinding the sheet from the bobbin, keeping the roller in contact with an outer surface of the bobbin.

2. The method according to claim 1, wherein the roller moves its angular position with respect of the bobbin while unwinding.

3. The method according to claim 1, including rotating the roller in a direction opposite to a rotation direction of the bobbin during unwinding.

4. The method according to claim 1, including placing the free portion of the sheet in contact with the roller for a length equal to at least about 40% of a perimeter of the roller.

5. The method according to claim 1, including arranging a scraper between the free portion of the sheet and the remaining of the sheet coiled in the bobbin in such a way that the scraper is in contact with the sheet coiled in the bobbin.

6. The method according to claim 1, including:

determining a roundness of the bobbin;

selecting an unwinding velocity of the bobbin based on the determined roundness.

7. The method according to claim 1, including sensing a diameter of the bobbin.

8. A kit to unwind a sheet of material wound in a bobbin, the kit comprising:

a bobbin of a coiled sheet including a homogenized tobacco sheet defining an outer surface and a free portion of the sheet unwound from the bobbin, the free portion defining a contact line as a line separating the free portion and the remaining of the coiled sheet;

an apparatus including:

a bobbin holder holding the bobbin rotatable around a first axis;

a roller having a second rotation axis substantially parallel to the first rotation axis, the roller being in contact with the outer surface of the bobbin at the contact line;

a pulling device adapted to pull the free portion of the sheet of the bobbin along an unwinding direction;

wherein the roller and the pulling device are respectively positioned so that an angle between the free portion of the sheet along the unwinding direction and a radius of the bobbin at the contact line is comprised between about 110 degrees and about 150 degrees or between about 200 degrees and about 300 degrees.

9. The kit according to claim 8, wherein the roller is arranged in a angularly movable position with respect of the holder.

10. The kit according to claim 8, wherein the apparatus includes a scraper arranged between the free portion of the sheet and the remaining of the sheet coiled in the bobbin in such a way that the scraper is in contact with the sheet coiled in the bobbin.

11. The kit according to claim 8, wherein the apparatus includes a speed regulator to vary a rotation speed around the first axis of the bobbin holder.

12. The kit according to claim 8, wherein the apparatus includes a diameter sensor to determine the diameter of the bobbin.

* * * * *